US008608443B2

(12) United States Patent
Lee et al.

(10) Patent No.: US 8,608,443 B2
(45) Date of Patent: Dec. 17, 2013

(54) FILM COOLED COMPONENT WALL IN A TURBINE ENGINE

(75) Inventors: Ching-Pang Lee, Cincinnati, OH (US); Jae Y. Um, Winter Garden, FL (US); Mrinal Munshi, Orlando, FL (US); Humberto A. Zuniga, Casselberry, FL (US)

(73) Assignee: Siemens Energy, Inc., Orlando, FL (US)

( * ) Notice: Subject to any disclaimer, the term of this patent is extended or adjusted under 35 U.S.C. 154(b) by 741 days.

(21) Appl. No.: 12/813,602

(22) Filed: Jun. 11, 2010

(65) Prior Publication Data

US 2011/0305582 A1 Dec. 15, 2011

(51) Int. Cl.
*F01D 9/06* (2006.01)
*F01D 5/18* (2006.01)

(52) U.S. Cl.
USPC ..... 416/97 R; 415/115

(58) Field of Classification Search
USPC ..... 416/97 A, 97 R, 96 R; 415/115, 116
See application file for complete search history.

(56) References Cited

U.S. PATENT DOCUMENTS

| | | | | |
|---|---|---|---|---|
| 3,899,267 | A | 8/1975 | Dennis et al. | |
| 3,982,851 | A | 9/1976 | Andersen et al. | |
| 5,458,461 | A | 10/1995 | Lee et al. | |
| 5,651,662 | A | 7/1997 | Lee et al. | |
| 5,660,525 | A | 8/1997 | Lee et al. | |
| 5,683,600 | A | 11/1997 | Kelley et al. | |
| 6,234,755 | B1 * | 5/2001 | Bunker et al. | 416/97 R |
| 6,307,175 | B1 | 10/2001 | Blochlinger et al. | |
| 6,383,602 | B1 | 5/2002 | Fric et al. | |
| 7,328,580 | B2 | 2/2008 | Lee et al. | |
| 7,351,036 | B2 | 4/2008 | Liang | |
| 7,553,534 | B2 | 6/2009 | Bunker | |
| 2005/0084657 | A1 * | 4/2005 | Ohara | 428/195.1 |
| 2008/0057271 | A1 | 3/2008 | Bunker | |
| 2009/0246011 | A1 | 10/2009 | Itzel | |

FOREIGN PATENT DOCUMENTS

| | | | |
|---|---|---|---|
| EP | 1091090 | A2 | 4/2001 |
| EP | 1847684 | A1 | 10/2007 |
| GB | 2438861 | A | 12/2007 |

OTHER PUBLICATIONS

Ching-Pang Lee et al.; U.S. patent application entitled "Component Wall Having Diffusion Sections for Cooling in a Turbine Engine".

* cited by examiner

*Primary Examiner* — Christopher Verdier

(57) ABSTRACT

A component wall in a turbine engine. The component wall includes a substrate, a trench, and a plurality of cooling passages. The substrate has a first surface and a second surface opposed from the first surface. The trench is located in the second surface and is defined by a bottom surface between the first and second surfaces, a first sidewall, and a second sidewall spaced from the first sidewall. The first sidewall extends radially outwardly continuously from the bottom surface of the trench to the second surface. The first sidewall includes a plurality of first protuberances extending toward the second sidewall. The cooling passages extend through the substrate from the first surface to the bottom surface of the trench. Outlets of the cooling passages are arranged within the trench such that cooling air exiting the cooling passages is directed toward respective ones of the first protuberances.

20 Claims, 9 Drawing Sheets

FILM COOLED COMPONENT WALL IN A TURBINE ENGINE

FIELD OF THE INVENTION

The present invention relates to turbine engines, and, more particularly, to film cooling passages provided in the sidewall of a component, such as the sidewall for an airfoil in a gas turbine engine.

BACKGROUND OF THE INVENTION

In a turbomachine, such as a gas turbine engine, air is pressurized in a compressor then mixed with fuel and burned in a combustor to generate hot combustion gases. The hot combustion gases are expanded within a turbine of the engine where energy is extracted to power the compressor and to provide output power used to produce electricity. The hot combustion gases travel through a series of turbine stages. A turbine stage may include a row of stationary airfoils, i.e., vanes, followed by a row of rotating airfoils, i.e., turbine blades, where the turbine blades extract energy from the hot combustion gases for powering the compressor and providing output power.

Since the airfoils, i.e., vanes and turbine blades, are directly exposed to the hot combustion gases as the gases pass through the turbine, these airfoils are typically provided with internal cooling circuits that channel a coolant, such as compressor bleed air, through the airfoil and through various film cooling holes around the surface thereof. For example, film cooling holes are typically provided in the walls of the airfoils for channeling the cooling air through the walls for discharging the air to the outside of the airfoil to form a film cooling layer of air, which protects the airfoil from the hot combustion gases.

Film cooling effectiveness is related to the concentration of film cooling fluid at the surface being cooled. In general, the greater the cooling effectiveness, the more efficiently the surface can be cooled. A decrease in cooling effectiveness causes greater amounts of cooling air to be employed to maintain a certain cooling capacity, which may cause a decrease in engine efficiency.

SUMMARY OF THE INVENTION

In accordance with a first aspect of the present invention, a component wall is provided in a turbine engine. The component wall comprises a substrate, a trench, and a plurality of cooling passages. The substrate has a first surface and a second surface opposed from the first surface. The trench is located in the second surface and is defined by a bottom surface between the first and second surfaces, a first sidewall, and a second sidewall spaced from the first sidewall. The first sidewall extends radially outwardly continuously from the bottom surface of the trench to the second surface. The first sidewall comprises a plurality of first protuberances extending toward the second sidewall. The cooling passages extend through the substrate from the first surface to the bottom surface of the trench. Outlets of the cooling passages are arranged within the trench such that cooling air exiting the cooling passages through the outlets is directed toward respective ones of the first protuberances of the first sidewall.

In accordance with a second aspect of the present invention, a component wall is provided in a turbine engine. The component wall comprises a substrate, a trench, and a plurality of cooling passages. The substrate has a first surface and a second surface opposed from the first surface. The trench is located in the second surface and is defined by a bottom surface between the first and second surfaces, a first sidewall, and a second sidewall spaced from the first sidewall. The first sidewall comprises a plurality of first protuberances extending toward the second sidewall and the second sidewall comprising a plurality of second protuberances extending toward the first sidewall and located between adjacent ones of the first protuberances. The cooling passages extend through the substrate from the first surface to the bottom surface of the trench. Outlets of the cooling passages are arranged within the trench such that cooling air exiting the cooling passages from the outlets is directed toward respective ones of the first protuberances of the first sidewall.

In accordance with a third aspect of the present invention, a method is provided for forming a trench in a component wall of a turbine engine. An outer surface of an inner layer of the component wall is masked with a removable material so as to define a shape of a trench to be formed in the component wall. The removable material blocks an outlet of at least one cooling passage extending through the inner layer of the component wall. The removable material is configured such that at least one protuberance of the to-be formed trench will be aligned with a respective cooling passage outlet. A material is disposed on the outer surface of the inner layer to form an outer layer of the component wall over the inner layer. The removable material is removed from the component wall such that a trench is formed in the component wall where the removable material was previously located. The trench is defined by a bottom surface, a first sidewall, and a second sidewall. The bottom surface corresponds to the surface area of the outer surface of the inner layer of the component wall where the removable material was previously located. The first sidewall is defined by the material forming the outer layer of the component wall. The second sidewall is spaced from the first sidewall and is defined by the material forming the outer layer of the component wall. The first sidewall comprises the at least one protuberance that is aligned with the respective cooling passage outlet, which at least one protuberance extends toward the second sidewall. Removing the removable material unblocks the outlet of the at least one cooling passage such that cooling air is able to pass through the cooling passage and out of the outlet thereof toward the respective protuberance of the first sidewall.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
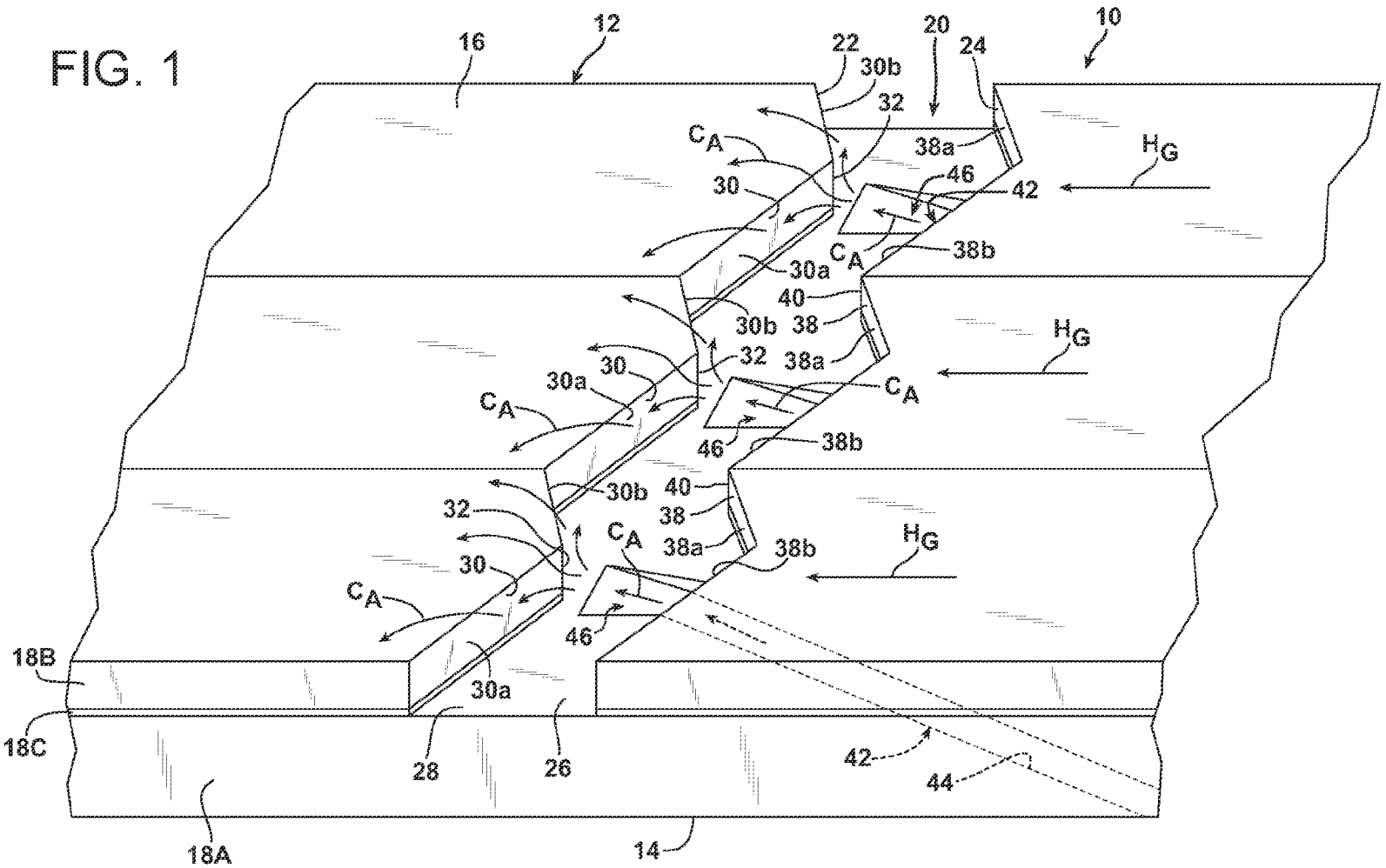
FIG. 1 is a perspective view of a portion of a film cooled component wall according to an embodiment of the invention.

Referring to FIG. 1, a film cooled component wall 10 according to an embodiment of the invention is shown. The component wall 10 may comprise a portion of a component in turbine engine, such as an airfoil, i.e., a rotating turbine blade or a stationary vane, a combustion liner, an exhaust nozzle, and the like.

The component wall 10 comprises a substrate 12 having a first surface 14 and a second surface 16. The first surface 14 may be referred to as the "cool" surface, as the first surface 14 may be exposed to cooling air, while the second surface 16 may be referred to as the "hot" surface, as the second surface 16 may be exposed to hot combustion gases during operation. Such combustion gases may have temperatures of up to about 2,000° C. during operation of the engine. In the embodiment shown, the first surface 14 and the second surface 16 are opposed and substantially parallel to each other.

The material forming the substrate 12 may vary depending on the application of the component wall 10. For example, for turbine engine components, the substrate 12 preferably comprises a material capable of withstanding typical operating conditions that occur within the respective portion of the engine, such as, for example, ceramics and metal-based materials, e.g., steel or nickel, cobalt, or iron based superalloys, etc.

Figure 2:
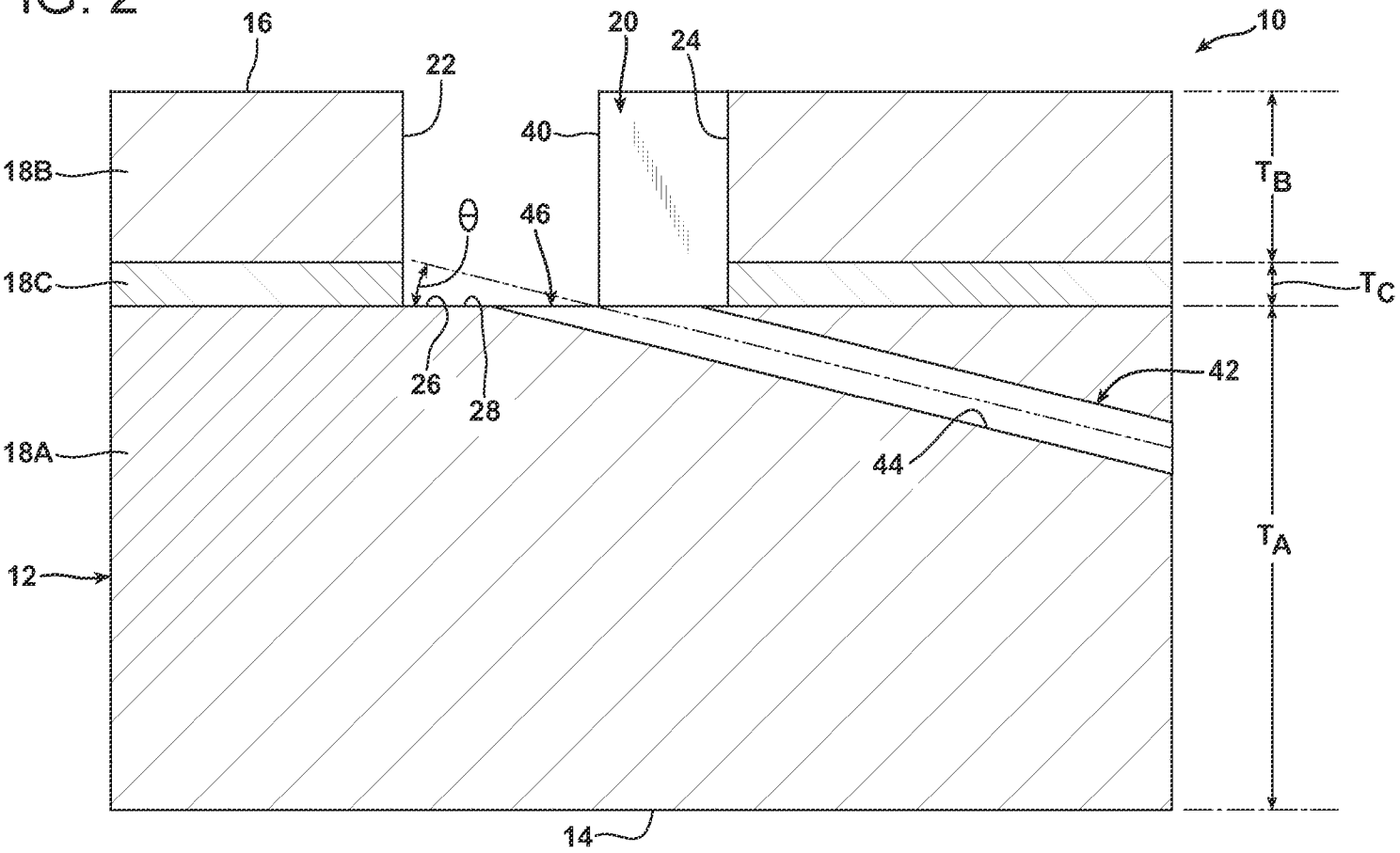
FIG. 2 is a side cross sectional view of the film cooled component wall shown in FIG. 1.

Referring to FIG. 2, the substrate 12 may comprise one or more layers, and in the embodiment shown comprises an inner layer 18A, an outer layer 18B, and an intermediate layer 18C between the inner and outer layers 18A, 18B. The inner layer 18A in the embodiment shown comprises, for example, steel or a nickel, cobalt, or iron based superalloy, and, in one embodiment, may have a thickness $T_A$ of about 1.2 mm to about 2.0 mm. The outer layer 18B in the embodiment shown comprises a thermal barrier coating that is employed to provide a high heat resistance for the component wall 10, and, in one embodiment, may have a thickness $T_B$ of about 0.5 mm to about 1.0 mm. The intermediate layer 18C in the embodiment shown comprises a bond coat that is used to bond the outer layer 18B to the inner layer 18A, and, in one embodiment, may have a thickness $T_C$ of about 0.1 mm to about 0.2 mm. While the substrate 12 in the embodiment shown comprises the inner, outer, and intermediate layers 18A, 18B, 18C, it is understood that substrates having additional or fewer layers could be used. For example, the thermal barrier coating, i.e., the outer layer 18B, may comprise a single layer or may comprise more than one layer. In a multi-layer thermal barrier coating application, each layer may comprise a similar or a different composition and may comprise a similar or a different thickness.

Figure 3:
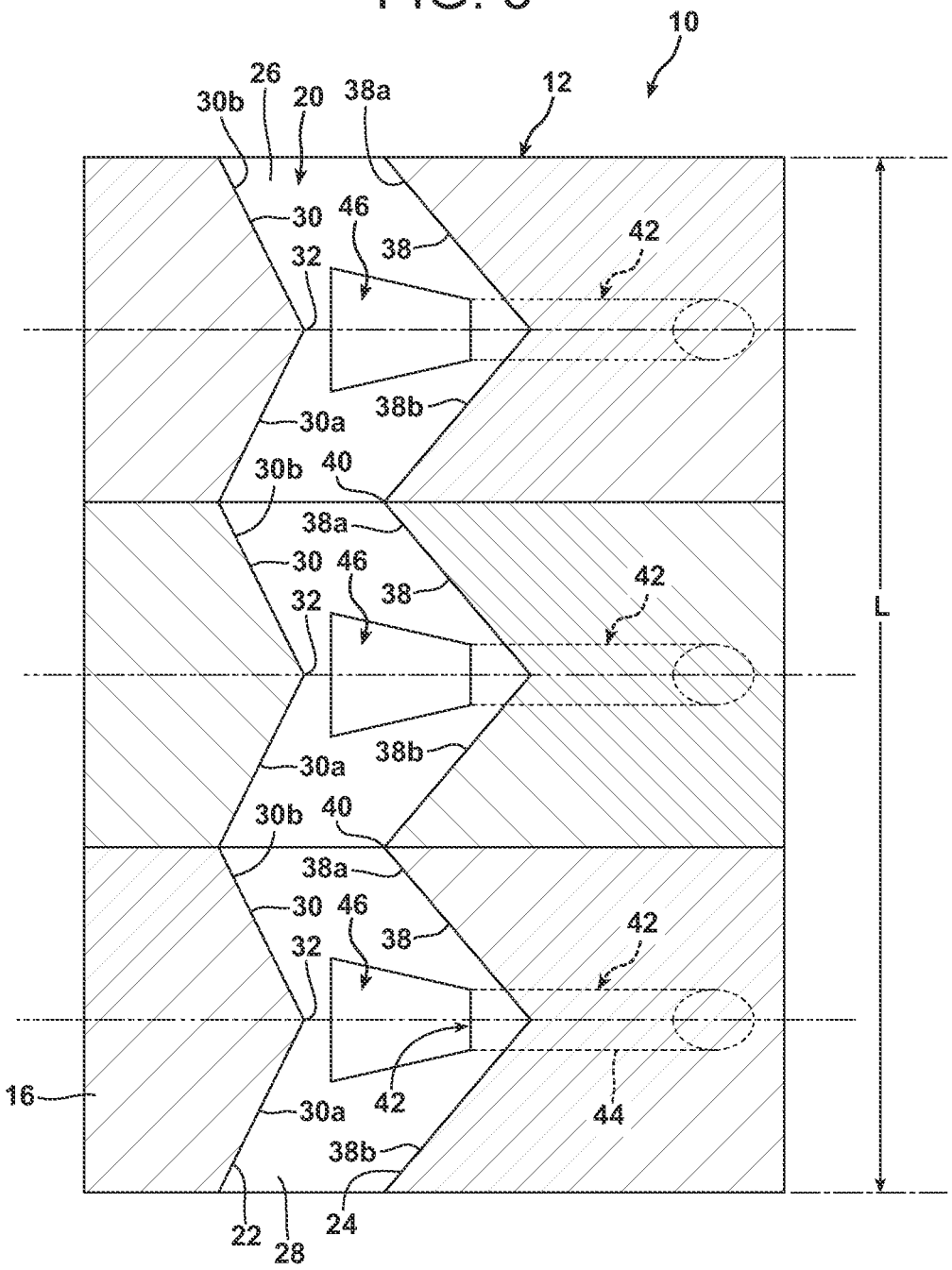
FIG. 3 is a plan cross sectional view of the film cooled component wall shown in FIG. 1.

As shown in FIGS. 1-3, a trench 20, also referred to as a diffuser section or slot, is formed in the component wall 10. The trench 20 is formed in the second surface 16 of the substrate 12, i.e., the trench 20 extends through the outer layer 18B or both the outer and intermediate layers 18B, 18C in the embodiment shown (see FIG. 2), and extends longitudinally across the second surface 16.

The trench 20 comprises a first sidewall 22, a second sidewall 24 spaced from the first sidewall 22, and a bottom surface 26. It is noted that the first sidewall 22 is downstream from the second sidewall 24 with respect to the direction of hot gas $H_G$ (see FIG. 1) flow during operation, as will be described in greater detail herein. The first and second sidewalls 22, 24 each extend radially outwardly continuously from the bottom surface 26 of the trench 20 to the second surface 16 of the substrate 12. That is, the entireties of the first and second sidewalls 22, 24 extend continuously generally perpendicular, in the radial direction between the bottom surface 26 and the second surface 16, along a length L (see FIG. 3) of the trench 20. Further, in the embodiment shown the first and second sidewalls 22, 24 are each substantially perpendicular to the second surface 16 of the substrate 12. The bottom surface 26 in the embodiment shown is defined by an outer surface 28 of the inner layer 18A of the substrate 12, as shown in FIG. 2. In the embodiment shown, the bottom surface 26 is substantially parallel to the second surface 16 of the substrate 12 and also to the first surface 14 of the substrate 12.

As shown in FIGS. 1 and 3, the first sidewall 22 comprises a series of first protuberances 30, which may also be referred to as bumps, bulges, etc., which first protuberances 30 extend axially or generally parallel to the direction of hot gas $H_G$ flow toward the second sidewall 24. The first protuberances 30 according to this embodiment each comprise an apex 32 and adjacent wall portions 30*a*, 30*b* extending in diverging relation, in the direction of hot gas $H_G$ flow, from the apex 32. The first protuberances 30 are arranged so as to give the first sidewall 22 a zigzag or serpentine configuration. While the shapes of the first protuberances 30 may vary, the shapes are configured so as to effect a diverging flow of cooling air $C_A$ (see FIG. 1) along the first sidewall 22 during operation to change the direction of the flow of cooling air $C_A$ from generally parallel to the hot gas $H_G$ flow to transverse to the hot gas $H_G$ flow, as will be discussed in detail herein. Further, while all of the first protuberances 30 in the embodiment shown comprise generally the same shape, it is understood that one or more of the first protuberances 30 may comprise one or more different shapes. It is also noted that the apexes 32 of the first protuberances 30 can comprise sharp angles or can be rounded to various degrees.

Referring still to FIGS. 1 and 3, the second sidewall 24 in the embodiment shown comprises a series of second protuberances 38, which may also be referred to as bumps, bulges, etc., which second protuberances 38 extend axially or generally parallel to the direction of hot gas $H_G$ flow toward the first sidewall 22. The second protuberances 38 according to this embodiment each comprise an apex 40 and adjacent wall portions 38*a*, 38*b* extending in converging relation, in the direction of hot gas $H_G$ flow, toward the apex 40. The second protuberances 38 are arranged so as to give the second sidewall 24 a zigzag or serpentine configuration. While all of the second protuberances 38 in the embodiment shown comprise generally the same shape, it is understood that one or more of the second protuberances 38 may comprise one or more different shapes. It is also noted that the apexes 40 of the second protuberances 38 can comprise sharp angles or can be rounded to various degrees. It is further noted that the second sidewall 24 need not include the second protuberances 38. For example, the second sidewall 24 may comprise a generally straight sidewall 24 extending in the direction of the length L of the trench 20.

As shown most clearly in FIG. 3, the configuration of the first and second sidewalls 22, 24 provides the trench 20 with a generally zigzag or serpentine configuration, wherein the first protuberances 30 of the first sidewall 22 are arranged between adjacent ones of the second protuberances 38 of the second sidewall 24 and the second protuberances 38 of the second sidewall 24 are arranged between adjacent ones of the first protuberances 30 of the first sidewall 22. Thus, a distance between the first sidewall 22 and the second sidewall 24 is generally similar for a substantial length L of the trench 20.

Referring to FIGS. 1-3, a plurality of cooling passages 42 extend through the substrate 12 from the first surface 14 of the substrate 12 to the bottom surface 26 of the trench 20, i.e., the cooling passages 42 extend through the first layer 18A in the embodiment shown. In this embodiment, the cooling passages 42 are inclined, i.e., extend at an angle θ through the substrate 12, as shown in FIG. 2. The angle θ may be, for example, about 15 degrees to about 60 degrees relative to a plane defined by the bottom surface 26, and in a preferred embodiment is between about 30 degrees to about 45 degrees. As shown in FIGS. 1 and 3, the cooling passages 42 are spaced apart from each other along the length L of the trench 20.

The diameter of the cooling passages 42 may be uniform along their length or may vary. For example, throat portions 44 of the cooling passages 42 may be substantially cylindrical, while outlets 46 of the cooling passages 42 may be elliptical, diffuser-shaped, or may have any other suitable geometry. It is noted that the outlet 46 of each cooling passage 42 is the region at which that cooling passage 42 terminates at the bottom surface 26 of the trench 20. It is also noted that, if the outlets 46 of the cooling passages 42 comprise diffuser shapes, the portions of the substrate 12 that define the boundaries of an outlet 46 may be angled about 10 degrees relative to the axis of the respective cooling passage 42.

As shown in FIG. 1, the outlets 46 of the cooling passages 42 are arranged within the trench 20 such that the outlets 46 are axially aligned with and axially removed from respective apexes 32 of the first protuberances 30, such that the cooling air $C_A$ exiting the cooling passages 42 through the outlets 46 is directed toward respective ones of the first protuberances 30 of the first sidewall 22. This configuration advantageously allows the cooling air $C_A$ to flow into the apexes 32 of the protuberances 30 so as to effect a diverging flow of the cooling air $C_A$ along the adjacent wall portions 30*a*, 30*b* during operation, as indicated by the solid line arrows in FIG. 1.

Moreover, the cooling passages 42 are arranged so as to be located between adjacent ones of the second protuberances 38 of the second sidewall 24. This allows the distance between the first and second sidewalls 22, 24 to be generally similar for a substantial length L of the trench 20, as discussed above. The generally similar distance between the first and second sidewalls 22, 24 is believed to reduce hot gas ingestion into the trench 20, as will be discussed herein. Further, the second protuberances 38 of the second sidewall 24 provide an additional surface for guiding hot gas $H_G$ past the trench 20 to limit mixing of the hot gas $H_G$ with the cooling air $C_A$ in the trench 20, and to guide the cooling air $C_A$ as it diverges at the wall portions 30*a*, 30*b* by forming a substantially constant flow area along the trench 20.

In operation, the cooling air $C_A$, which may comprise, for example, compressor discharge air or any other suitable cooling fluid, travels from a source of cooling air (not shown) to the cooling passages 42. The cooling air $C_A$ flows through the cooling passages 42 and exits the cooling passages 42 via the outlets 46.

Subsequent to the cooling air $C_A$ flowing out of the outlets 46, the cooling air $C_A$ flows into the apexes 32 of the first protuberances 30 of the first sidewall 22. As shown in FIG. 1, the apexes 32 effect a diverging flow of the cooling air $C_A$ along the adjacent wall portions 30*a*, 30*b* so as to spread the cooling air $C_A$ within the trench 20. The spreading of the cooling air $C_A$ within the trench 20 creates a "sheet" of cooling air $C_A$ within substantially the entire trench 20 and improves film coverage of the cooling air $C_A$ within the trench 20. Hence, film cooling within the trench 20 provided by the cooling air $C_A$ is believed to be increased.

The hot gas $H_G$ flows along the second surface 16 of the substrate 12 toward the trench 20, as shown in FIG. 1. Since the cooling air $C_A$ in the trench 20 forms a sheet of cooling air $C_A$ within the trench 20 as discussed above, hot gas $H_G$ ingestion into the trench 20 is believed to be reduced. Rather, the majority of the hot gas $H_G$ is believed to flow over the trench 20 and the sheet of cooling air $C_A$ therein. Thus, the mixing of hot gas $H_G$ and cooling air $C_A$ within the trench 20 is believed to be reduced or substantially avoided.

As illustrated in FIG. 1, a portion of the cooling air $C_A$ flows out of the trench 20 over the first sidewall 22 to the second surface 16 of the substrate 12. This portion of the cooling air $C_A$ provides film cooling to the second surface 16 of the substrate 12. Since the mixing of hot gas $H_G$ and cooling air $C_A$ within the trench 20 is believed to be reduced or substantially avoided, as discussed above, a substantially evenly distributed "curtain" of cooling fluid $C_A$ flows out of the trench 20 and washes up over the second surface 16 of the substrate 12 to provide film cooling to the second surface 16. Film cooling to the second surface 16 of the substrate 12 is believed to be improved by the substantially evenly distributed curtain of cooling fluid $C_A$ flowing out of the trench 20 to the second surface 16.

Figure 4:
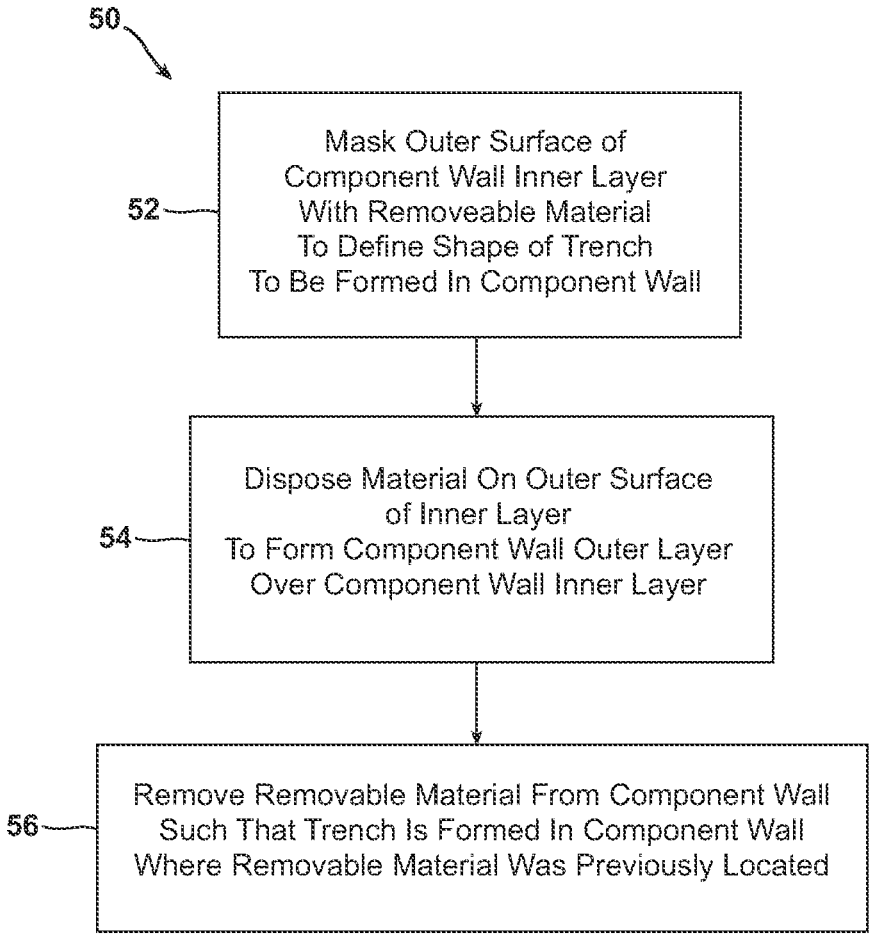
FIG. 4 illustrates a method for forming a trench in a component wall according to an embodiment of the invention.

Referring to FIG. 4, a method 50 for forming a trench in a component wall of a turbine engine is illustrated. For exemplary purposes, the component wall described herein with respect to FIG. 4 may be the same component wall 10 as described above with reference to FIG. 1-3.

Figure 4A:
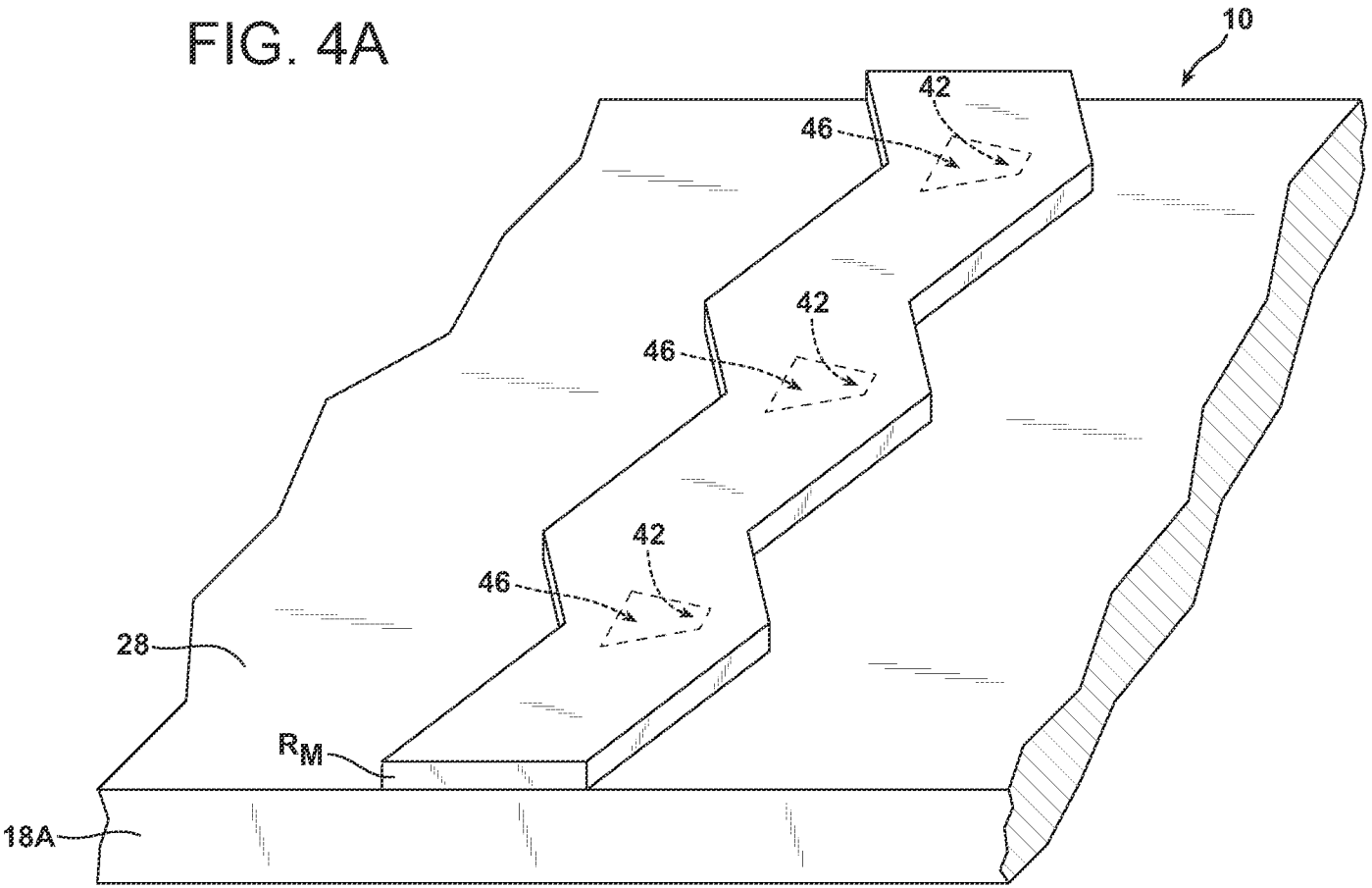
FIG. 4A illustrates a removable material used in the formation of the film cooled component wall shown in FIG. 1.

At step 52, an outer surface 28 of an inner layer 18A of the component wall 10 is masked with a removable material $R_M$ (see FIG. 4A) so as to define a shape of a trench 20 to be formed in the component wall 10. The removable material $R_M$ may be, for example, a tape structure or a masking material applied with a template. The removable material $R_M$ blocks outlets 46 of cooling passages 42 that extend through the inner layer 18A of the component wall 10. The removable material $R_M$ is configured such that first protuberances 30 of the to-be formed trench 20 will be aligned with outlets 46 of respective ones of the cooling passages 42. The removable material $R_M$ may be masked on the component wall 10 in a zigzag pattern such that the resulting trench 20 comprises a corresponding zigzag pattern, as shown in FIGS. 1 and 3.

At step 54, a material, e.g., a thermal barrier coating, is disposed on the outer surface 28 of the inner layer 18A to form an outer layer 18B of the component wall 10 over the inner layer 18A. Optionally, prior to disposing the outer layer 18B on the inner layer 18A, an intermediate layer 18C, e.g., a bond coat, may be applied to the inner layer 18A to facilitate a bonding of the outer layer 18B to the inner layer 18A.

At step 56, the removable material $R_M$ is removed from the component wall 10 such that a trench 20 is formed in the component wall 10 where the removable material $R_M$ was previously located. The trench 20 may be defined by a bottom surface 26, a first sidewall 22, and a second sidewall 24, as shown in FIGS. 1-3. The bottom surface 26 may correspond to the surface area of the outer surface 28 of the inner layer 18A where the removable material $R_M$ was previously located. The first sidewall 22 may be defined by the material forming the outer layer 18B of the component wall 10, and comprises the first protuberances 30 that are aligned with the outlets 46 of the cooling passages 42 and that extend toward the second sidewall 24. The second sidewall 24 is spaced from the first sidewall 22 and may be defined by the material forming the outer layer 18B of the component wall 10. The removable material $R_M$ may also be disposed on the outer surface 28 of the inner layer 18A so as to create the second protuberances 38 in the second sidewall 24 as described above.

Removing the removable material $R_M$ at step 56 unblocks the outlets 46 of the cooling passages 42 such that cooling air $C_A$ may pass through the cooling passages 42 and out of the outlets 46 thereof toward the first protuberances 30 of the first sidewall 22.

It is noted that the component wall 10 disclosed herein may comprise more than one trench 20 or slot, which may or may not extend over the entire second surface 16 of the substrate 12. If the component wall 10 comprises multiple trenches 20, the number, shape, and arrangement of the additional cooling passages 42 and the outlets 46 thereof may be the same or different than in the trench 20 described herein. Further, the shape of the first and/or second protuberances 30, 38 of the first and second sidewalls 22, 24 may be the same or different than those of the trench 20 described herein.

Advantageously, increased performance for both cooling and aerodynamics can be realized with the disclosed component wall 10 described herein as compared to existing film-cooled component walls. Further, the method 50 disclosed herein may be employed to efficiently form one or more trenches 20 in a component wall 10, wherein outlets 46 of cooling passages 42 formed in the component wall 10 become unblocked with the removal of the removable material $R_M$, such that cooling air $C_A$ may flow out of the outlets 46 into the trench 20.

Referring now to FIGS. 5-8 component walls having trenches formed therein according to other embodiments are shown. In these figures, structure similar to that described above with reference to FIGS. 1-3 includes the same reference number increased by 100 for each respective figure. Further, only the structure that is different from that described above with reference to FIGS. 1-3 will be specifically described for each of FIGS. 5-8.

Figure 5:
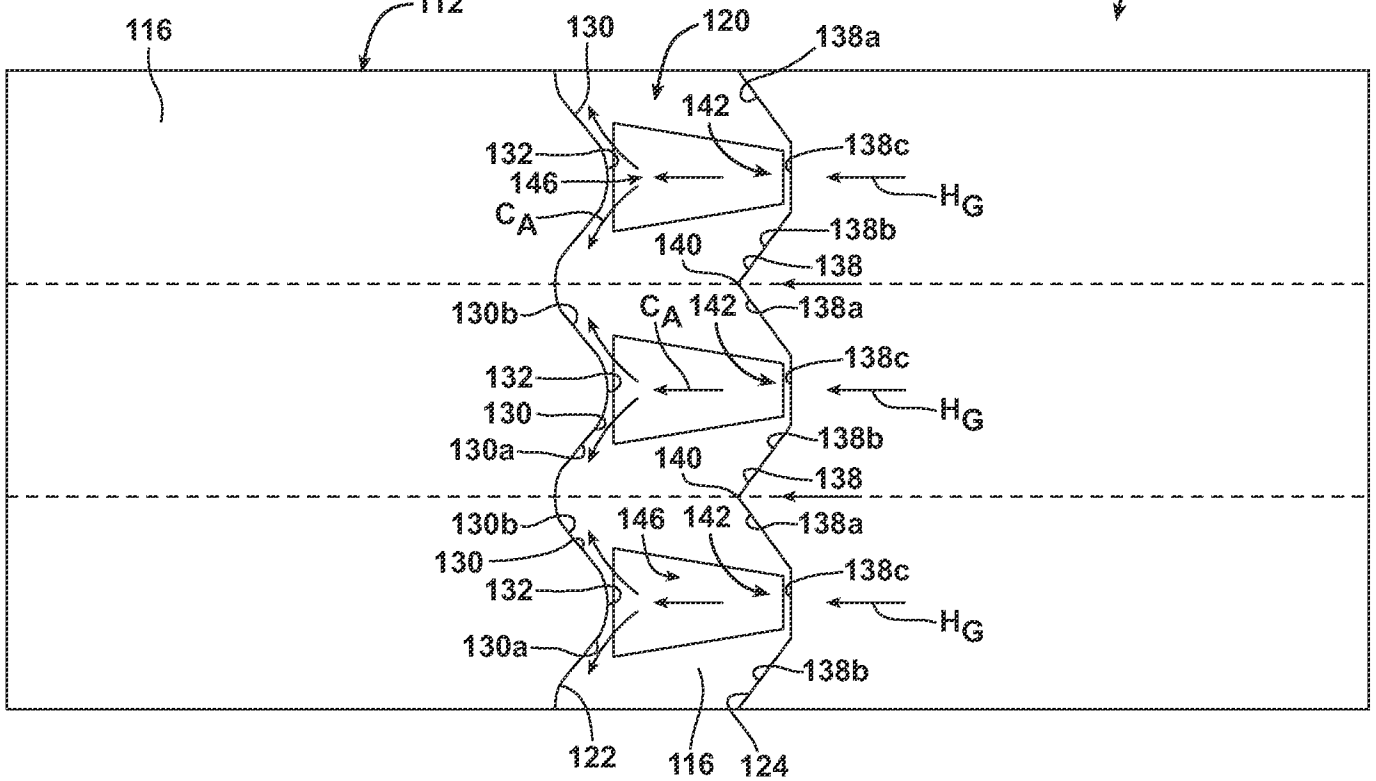
FIGS. 5-8 are elevational views of film cooled component walls according additional embodiments of the invention.

In FIG. 5, first protuberances 130 of a first sidewall 122 of a trench 120 are configured in a smooth, wave-like pattern. As indicated by the solid line arrows in FIG. 5, cooling air $C_A$ exiting from outlets 146 of cooling passages 142 is directed into apexes 132 of the first protuberances 130, and a diverging flow of cooling air $C_A$ is effected by wall portions 130*a*, 130*b*, which diverge from the apexes 132 to direct the cooling air $C_A$ along the first sidewall 122.

Second protuberances 138 of a second sidewall 124 of the trench 120 according to this embodiment comprise apexes 140 and adjacent wall portions 138*a*, 138*b* extending in converging relation, in the direction of hot gas $H_G$ flow, toward the apex 140. Further, intermediate wall portions 138*c* of the second sidewall 124 extend between respective wall portions 138*a*, 138*b* adjacent to the outlets 146 of the cooling passages 142. The intermediate wall portions 138*c* reduce the area where hot gas $H_G$ can enter the trench 120, so as to further reduce mixing of hot gas $H_G$ with the cooling air $C_A$ in the trench 120.

As with the embodiment described above with reference to FIGS. 1-3, the apexes 132 of the first sidewall 122 are arranged between the apexes 140 of the second sidewall 124, and vice versa, to provide for a generally similar distance between the first and second sidewalls 122, 124.

Figure 6:
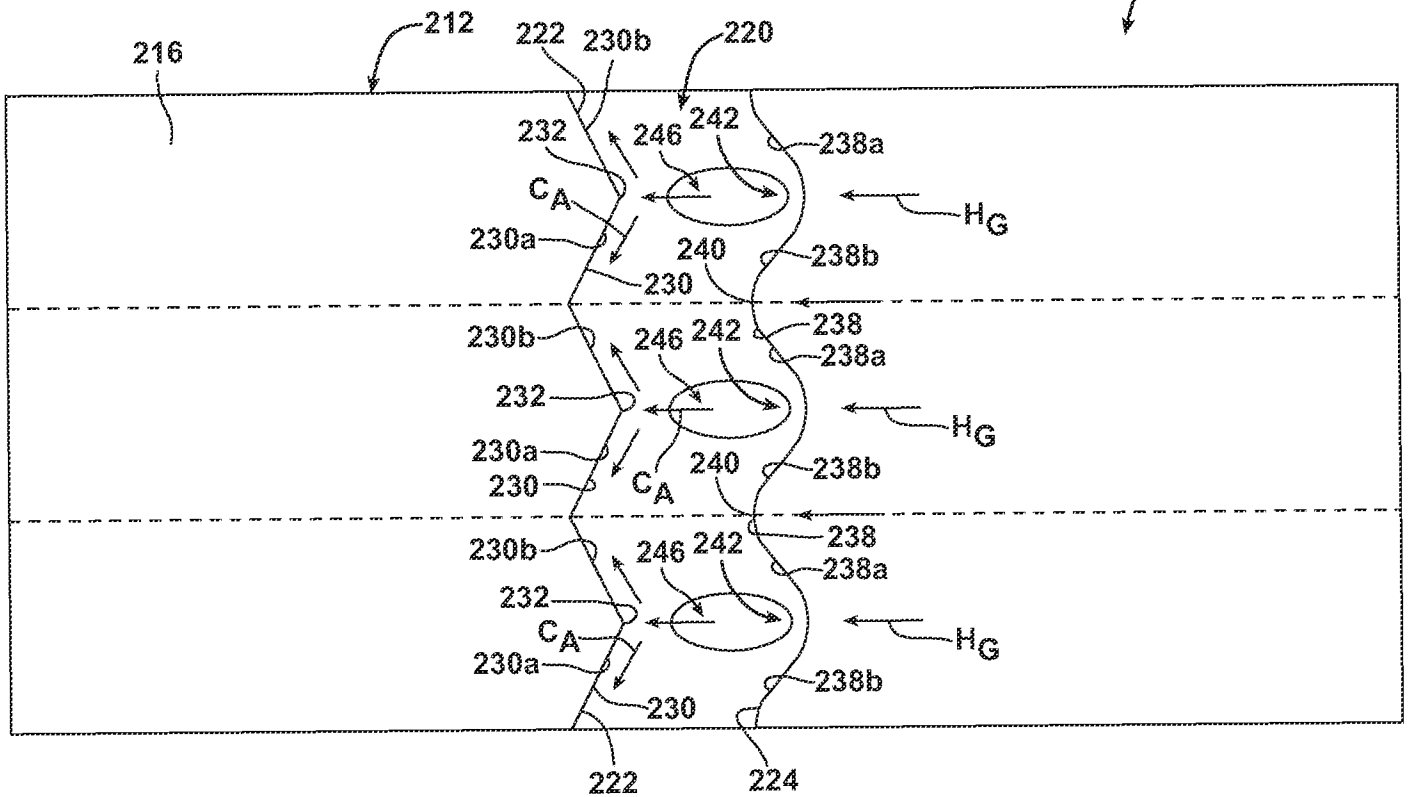

In FIG. 6, second protuberances 238 of a second sidewall 224 of a trench 220 are configured in a smooth, wave-like pattern. Further, outlets 246 of cooling passages 242 formed in the component wall 210 according to this embodiment comprise ovular shapes.

As with the embodiment described above with reference to FIGS. 1-3, apexes 232 of a first sidewall 222 are arranged between apexes 240 of the second sidewall 224, and vice versa, to provide for a generally similar distance between the first and second sidewalls 222, 224.

Figure 7:
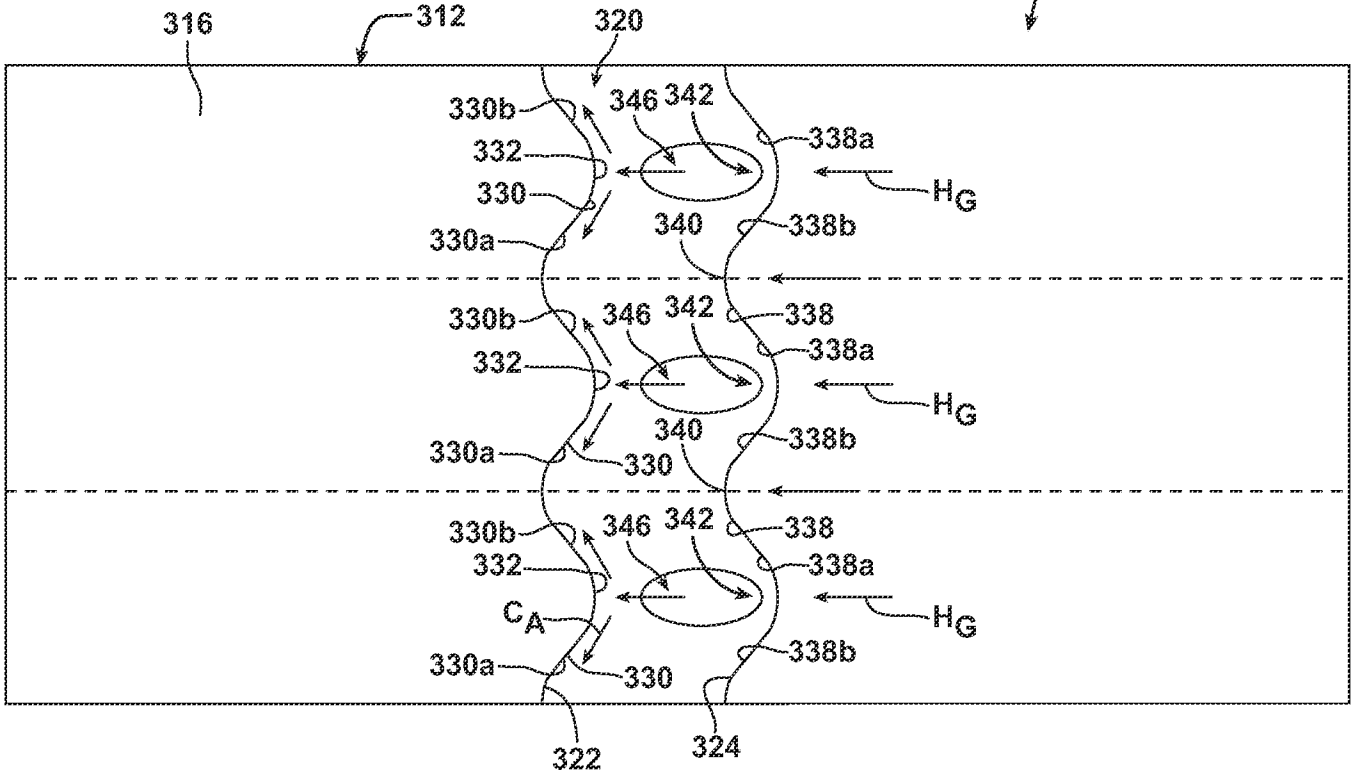

In FIG. 7 first protuberances 330 of a first sidewall 322 of a trench 320 are configured in a smooth, wave-like pattern. Additionally, second protuberances 338 of a second sidewall 324 of the trench 320 are configured in a smooth, wave-like pattern. Further, outlets 346 of cooling passages 342 formed in the component wall 310 according to this embodiment comprise ovular shapes.

As with the embodiment described above with reference to FIGS. 1-3, apexes 332 of the first sidewall 322 are arranged between apexes 340 of the second sidewall 324, and vice versa, to provide for a generally similar distance between the first and second sidewalls 322, 324.

Figure 8:
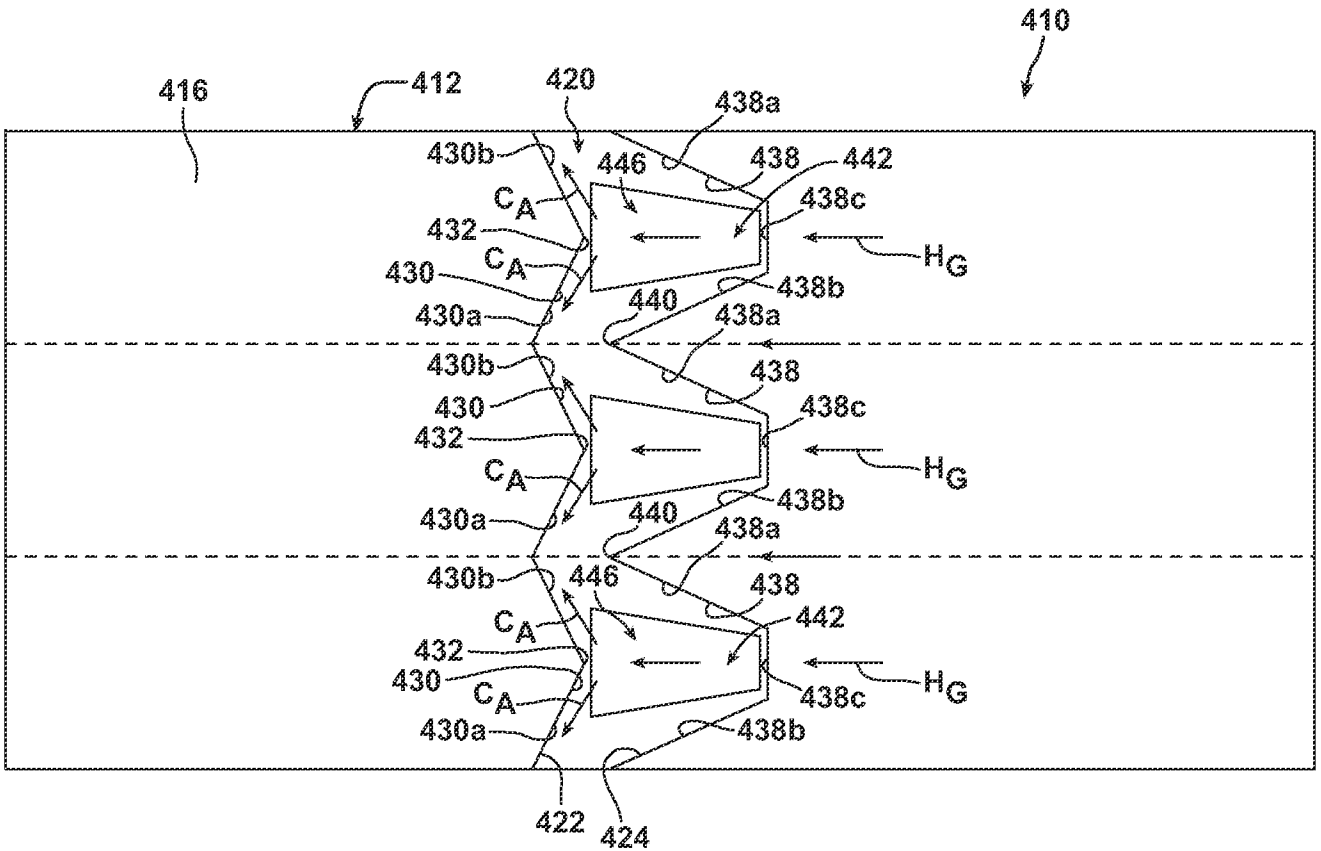

In FIG. 8, second protuberances 438 of a second sidewall 424 of a trench 420 extend further toward a first sidewall 422 than in the previous embodiments, and may extend to an axial location substantially corresponding to the ends of the outlets 46. Thus, the volume of the trench 420 is reduced, such that less cooling air $C_A$ is required to fill the trench 420, i.e., to form the sheet of cooling air $C_A$ within the trench 420. Moreover, the second protuberances 438 according to this embodiment provide extended surface area between the outlets 446 of the cooling passages 442 to direct the hot gas $H_G$ past the trench 420. Further, intermediate wall portions 438*c* of the second sidewall 424 according to this embodiment extend between respective wall portions 438*a*, 438*b* of the second sidewall 424 adjacent to outlets 446 of cooling passages 442. The intermediate wall portions 438*c* reduce the area where hot gas $H_G$ can enter the trench 420, so as to further reduce mixing of hot gas $H_G$ with the cooling air $C_A$ in the trench 420.

As with the embodiment described above with reference to FIGS. 1-3, apexes 432 of the first sidewall 422 are arranged between apexes 440 of the second sidewall 424, and vice versa, to provide for a generally similar distance between the first and second sidewalls 422, 424.

The trenches described herein may be formed as part of a repair process or may be implemented in new airfoil designs. Further, the trenches may be formed by other processes than the one described herein. For example, the substrate may comprise a single layer and a trench may be machined in the outer surface of the substrate layer.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A component wall in a turbine engine comprising:

a substrate having a first surface and a second surface opposed from said first surface;

a trench located in said second surface, said trench defined by a bottom surface between said first and second surfaces, a first sidewall, and a second sidewall spaced from said first sidewall, said first sidewall extending radially outwardly continuously from said bottom surface of said trench to said second surface, said first sidewall comprising a plurality of first protuberances extending toward said second sidewall and said second sidewall comprising a plurality of second protuberances extending toward said first sidewall; and a plurality of cooling passages extending through said substrate from said first surface to said bottom surface of said trench, wherein outlets of said cooling passages are arranged within said trench such that cooling air exiting said cooling passages through said outlets is directed toward respective ones of said first protuberances of said first sidewall.

2. The component wall of claim 1, wherein said first and second sidewalls are substantially perpendicular to said second surface.

3. The component wall of claim 1, wherein at least one of said cooling passage outlets comprises a diffuser shape.

4. The component wall of claim 1, wherein said cooling passages extend through said substrate at an angle.

5. The component wall of claim 4, wherein the angle is from about 15 degrees to about 60 degrees relative to said bottom surface of said trench.

6. The component wall of claim 1, wherein said second surface and said bottom surface of said trench are substantially parallel to one another.

7. The component wall of claim 1, wherein said second protuberances of said second sidewall are located between adjacent ones of said cooling passages.

8. The component wall of claim 7, wherein:

said first protuberances of first sidewall are located between adjacent ones of said second protuberances of said second sidewall; and said second protuberances of second sidewall are located between adjacent ones of said first protuberances of said first sidewall such that a distance between said first sidewall and said second sidewall is generally similar for a substantial length of said trench.

9. The component wall of claim 1, wherein said first protuberances of said first sidewall comprise an apex aligned with an outlet of a respective cooling passage to effect a diverging flow of cooling air along said first sidewall.

10. The component wall of claim 9, wherein said apexes of said first sidewall are axially removed from said outlets of said cooling passages, the axial direction defined by a direction between said first and second sidewalls.

11. The component wall of claim 1, wherein said trench defines a zigzag shape.

12. The component wall of claim 1, wherein said second surface comprises a thermal barrier coating.

13. A component wall in a turbine engine comprising:

a substrate having a first surface and a second surface opposed from said first surface;

a trench located in said second surface, said trench defined by a bottom surface between said first and second surfaces, a first sidewall, and a second sidewall spaced from said first sidewall, said first sidewall comprising a plurality of first protuberances extending toward said second sidewall and said second sidewall comprising a plurality of second protuberances extending toward said first sidewall and located between adjacent ones of said first protuberances; and a plurality of cooling passages extending through said substrate from said first surface to said bottom surface of said trench, wherein outlets of said cooling passages are arranged within said trench such that cooling air exiting said cooling passages from said outlets is directed toward respective ones of said first protuberances of said first sidewall.

14. The component wall of claim 13, wherein said first sidewall extends radially outwardly continuously from said bottom surface of said trench to said second surface.

15. The component wall of claim 13, wherein said second protuberances of said second sidewall are located between adjacent ones of said cooling passages.

16. The component wall of claim 15, wherein said first protuberances of first sidewall are located between adjacent ones of said second protuberances of said second sidewall such that a distance between said first sidewall and said second sidewall is generally similar for a substantial length of said trench.

17. The component wall of claim 13, wherein said first protuberances of said first sidewall comprise an apex aligned with an outlet of a respective cooling passage to effect a diverging flow of cooling air along said first sidewall.

18. The component wall of claim 17, wherein said apexes of said first sidewall are axially removed from said outlets of said cooling passages, the axial direction defined by a direction between said first and second sidewalls.

19. The component wall of claim 13, wherein said trench defines a zigzag shape.

20. A method of forming a trench in a component wall of a turbine engine comprising:

masking an outer surface of an inner layer of the component wall with a removable material so as to define a shape of a trench to be formed in the component wall, said removable material blocking outlets of cooling passages extending through the inner layer of the component wall, wherein the removable material is configured such that protuberances of the to-be formed trench will be aligned with outlets of respective ones of the cooling passages;

disposing a material on the outer surface of the inner layer to form an outer layer of the component wall over the inner layer; and removing the removable material from the component wall such that a trench is formed in the component wall where the removable material was previously located, wherein the trench is defined by:

a bottom surface corresponding to the surface area of the outer surface of the inner layer of the component wall where the removable material was previously located;

a first sidewall defined by the material forming the outer layer of the component wall; and a second sidewall spaced from the first sidewall and defined by the material forming the outer layer of the component wall;

wherein:

the first sidewall comprises the protuberances that are aligned with the outlets of the cooling passages, the protuberances extending toward the second sidewall;

removing the removable material unblocks the outlets of the cooling passages such that cooling air is able to pass through the cooling passages and out of the outlets thereof toward the protuberances of the first sidewall; and masking an outer surface of an inner layer comprises applying one of a tape structure and a masking material with a template in one of a zigzag pattern and a serpentine pattern to the outer surface of the inner layer to effect a corresponding zigzag or serpentine shape for each of the first and second sidewalls.

* * * * *